US010993525B2

(12) United States Patent
Polidoros

(10) Patent No.: US 10,993,525 B2
(45) Date of Patent: May 4, 2021

(54) FOLDING TABLE

(71) Applicant: IHS Global Design Pty Ltd, Melbourne (AU)

(72) Inventor: Nicholas Polidoros, Melbourne (AU)

(73) Assignee: IHS GLOBAL DESIGN PTY LTD, Melbourne (AU)

( * ) Notice: Subject to any disclaimer, the term of this patent is extended or adjusted under 35 U.S.C. 154(b) by 0 days.

(21) Appl. No.: 16/562,706

(22) Filed: Sep. 6, 2019

(65) Prior Publication Data

US 2020/0077784 A1 Mar. 12, 2020

(30) Foreign Application Priority Data

Sep. 6, 2018 (AU) ..... 2018903319

(51) Int. Cl.
*A47B 3/08* (2006.01)

(52) U.S. Cl.
CPC ..... *A47B 3/08* (2013.01); *A47B 2003/0821* (2013.01); *A47B 2003/0824* (2013.01)

(58) Field of Classification Search
CPC .... E05D 3/06; E05D 3/12; E05D 3/14; E05D 3/142; E05D 3/145; E05D 3/147; E05D 3/16; E05D 3/18; E05D 3/183; E05D 3/186; E05D 2003/163; E05D 2003/166; B62B 1/12; B62B 7/12; B62B 3/02; B62B 2202/30; A47B 3/08; A47B 2003/0821; A47B 2003/0824
USPC ..... 248/585, 588, 595, 421; 16/366, 368, 16/369, 370; 280/30, 47.18; 108/14, 18, 108/50.11, 115
See application file for complete search history.

(56) References Cited

U.S. PATENT DOCUMENTS

| | | | | | |
|---|---|---|---|---|---|
| 63,533 | A | * | 4/1867 | Langworthy | |
| 510,858 | A | * | 12/1893 | Hastings | |
| 2,409,495 | A | * | 10/1946 | Kelley | A47B 23/025 108/49 |
| 2,492,478 | A | * | 12/1949 | Homan | E05D 3/16 16/360 |
| 2,611,417 | A | * | 9/1952 | Henry | B25H 5/00 280/30 |

(Continued)

FOREIGN PATENT DOCUMENTS

| | | | |
|---|---|---|---|
| EP | 2030526 | A1 | 3/2009 |
| KR | 20070017918 | * | 2/2007 |
| WO | 2017083713 | * | 5/2017 |

OTHER PUBLICATIONS

European Application No. EP-19195293.6-1011, The Extended European Search Report and the European Seach Opinion of the European Searching Authority dated Nov. 15, 2019 (7 Pages).

*Primary Examiner* — Janet M Wilkens
(74) *Attorney, Agent, or Firm* — Lawrence N. Ginsberg

(57) ABSTRACT

A folding table (10), including a table top (12) having a top surface (18) and a bottom surface; two opposing legs (20) at or adjacent respective opposing ends (14) of the table top; the legs being movable between an unfolded position for supporting the table top above a floor surface, and a folded position whereby the legs lie underneath the bottom surface; at least one roller device (34) located towards an end of the table top; whereby in the unfolded position the roller is concealed behind the table top and leg, and in the folded position the roller is exposed to the end of the table top to allow rolling of the table in a tilted orientation along a floor surface.

18 Claims, 8 Drawing Sheets

(56) References Cited

U.S. PATENT DOCUMENTS

| | | | | | |
|---|---|---|---|---|---|
| 3,362,358 | A * | 1/1968 | Farish, III | A47B 3/083 | 108/170 |
| 4,098,198 | A * | 7/1978 | Patch | A47B 13/04 | 108/161 |
| 4,240,646 | A * | 12/1980 | Scott | B62B 3/02 | 16/34 |
| 5,092,615 | A * | 3/1992 | Gregalis | B62B 3/02 | 108/13 |
| 6,375,055 | B1 * | 4/2002 | Spykerman | B60R 5/045 | 108/12 |
| 6,401,631 | B1 * | 6/2002 | Kane | A47B 3/0911 | 108/116 |
| 8,424,136 | B2 * | 4/2013 | Rozewicz | A61G 13/00 | 280/30 |
| 9,357,842 | B2 * | 6/2016 | Gu | A47B 85/06 | |
| 9,738,295 | B1 * | 8/2017 | Horowitz | B62B 1/12 | |
| 2007/0261916 | A1 * | 11/2007 | Sward | G01N 33/497 | 182/129 |
| 2010/0032927 | A1 * | 2/2010 | Gordon | B62B 5/06 | 280/659 |
| 2012/0318083 | A1 * | 12/2012 | Hsu | H04M 1/0247 | 74/101 |
| 2013/0205503 | A1 * | 8/2013 | Rozewicz | A61G 13/009 | 5/620 |
| 2018/0098625 | A1 | 4/2018 | Li | | |
| 2019/0001481 | A1 * | 1/2019 | Faibish | B25H 1/04 | |

* cited by examiner

FOLDING TABLE

FIELD OF THE INVENTION

The present invention relates to a folding table, and more particularly to a folding table that is able to be rolled along the floor.

BACKGROUND OF THE INVENTION

It is desirable in large venues, such as conference centres, hotels and meeting halls, for tables to be able to be brought out from storage and arranged for a particular event, taking into consideration the number of people and the needs of the event.

For this reason, a number of different folding table configurations have been developed. The most common folding table has metal legs that are hinged to the underside of a table top. The legs fold underneath the table top and the folded tables are carried and stacked for storage.

Another type of foldable table has an underlying frame that includes wheels to allow rolling of the table. The table top may have a central split line that is hinged, so that the table top folds down around the frame to reduce with allowing tables to be stored next to each other in a smaller space. However, these types of tables still take up a large amount of storage space, as it is only as small as the width of the frame and wheel assembly.

There are other types where the frame may also hinge allowing the width to be reduced. However, these arrangements present a very undesirable visual presence, requiring the tables to be covered with a tablecloth to conceal the split line. The split line also can cause unevenness in the top surface if the two halves no longer align correctly.

Another known solution is to provide wheels on the underside of the table top. When the legs are folded underneath, the table can be tilted slightly and the table can be rolled to storage. However, this can compromise visual appearance as the wheels are exposed during use. They can also compromise storage, as they project perpendicularly from the table top under surface, increasing the depth of the folded table.

It is therefore desirable to provide a foldable table that offers an alternative to the current systems.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

Accordingly, the present invention provides a folding table, including:

a table top having a top surface and a bottom surface;

two opposing legs at or adjacent respective opposing ends of the table top; the legs being movable between an unfolded position for supporting the table top above a floor surface, and a folded position whereby the legs lie underneath the bottom surface;

at least one roller device located towards an end of the table top;

whereby in the unfolded position the roller is concealed behind the table top and leg, and in the folded position the roller is exposed to the end of the table top to allow rolling of the table in a tilted orientation along a floor surface.

The top surface of the table top is preferably generally planar. The legs are preferably panels extending in width the same as the depth of the table top and may have an exterior that is generally planar. The table top and leg may meet at a mitre joint. It will appreciated that alternative joints may be utilised.

The underside of the table top at one or both ends has cut out portions. The upper ends of the respective leg or legs have cut out portions. The cut out portions preferably do not extend the full width of the table top, such they are not visible from the sides or ends. The cut out portions may correspond to form a pocket on the inside of the corner when in the unfolded position. The pocket may be sized to receive a roller device. There may be: a single roller device at only one end; a single roller device at each end; multiple roller devices at one end; or multiple roller devices at each end.

The legs and table top are preferably connected by a standard corner hinge connection, having a first bracket on the table top and a second bracket on the leg, with a central pivot. The roller device may be connected to a scissor link hinge. The ends of the arms at one end being commonly connected to the roller device, and the ends of the arms at the other end being split and respectively attached to the corner hinge first and second brackets. As the leg is folded, the scissor link hinge extends the roller outwardly from and between the table top end and the upper end of the leg. As the leg is unfolded, the brackets move apart, drawing the ends of the scissor arms outwards and drawing the roller device inwards to sit within the pocket.

Advantageously, the scissor arms have different lengths such that they position the roller device downwards away from the table top.

BRIEF DESCRIPTION OF THE DRAWINGS

Further aspects of the present invention and further embodiments of the aspects described in the preceding paragraphs will become apparent from the following description, given by way of example and with reference to the accompanying drawings, in which.

DETAILED DESCRIPTION OF THE EMBODIMENTS

Figure 1:
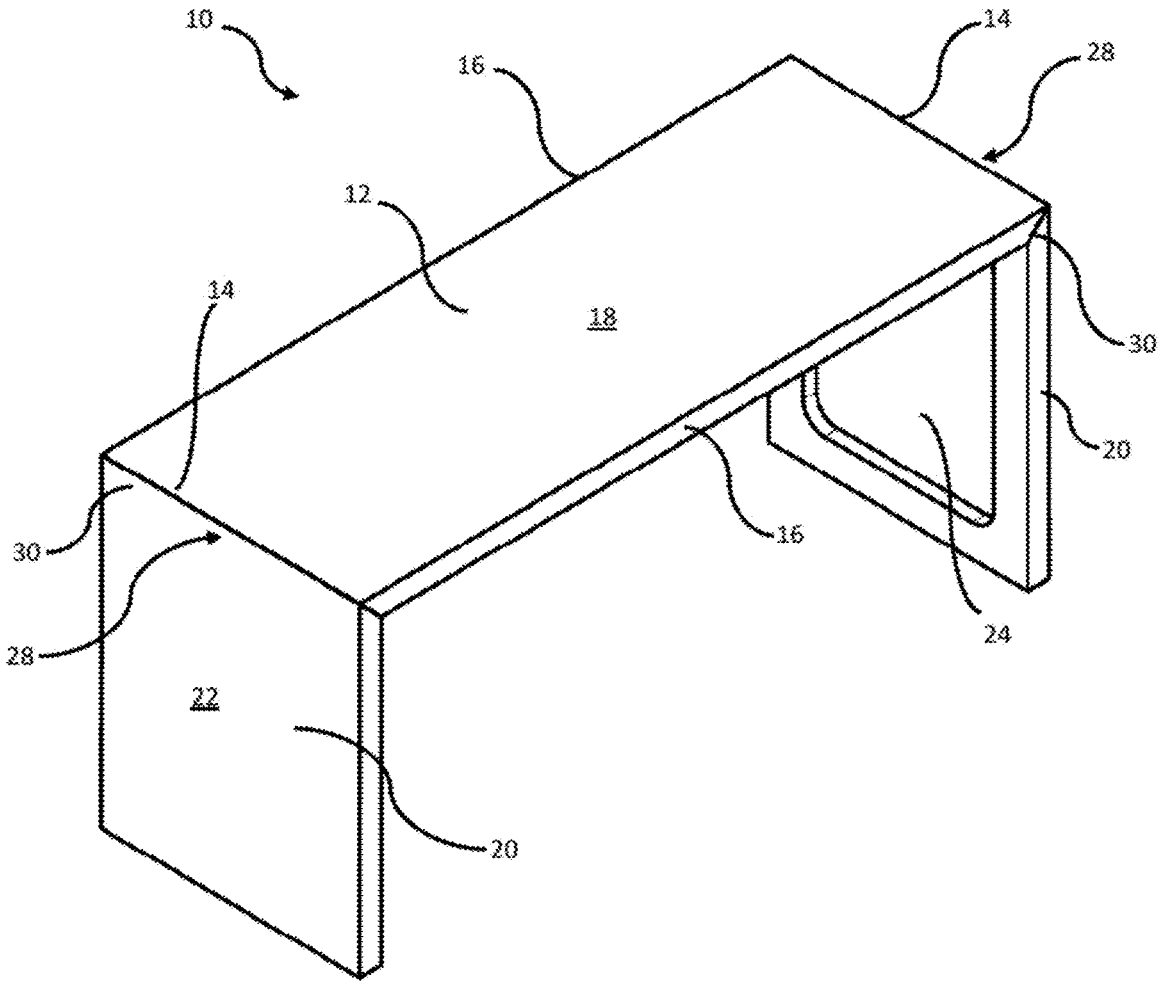
FIG. 1 is a perspective view of a foldable table according to a first embodiment, in the unfolded position.

FIG. 1 shows a table according to an embodiment of the present invention. The table 10 is positioned as it would be used for an event and have a table top 12, which is an elongate rectangular panel have two opposing ends 14 and opposing longitudinal sides 16. It will be appreciated that the present invention is applicable to table tops of any size and shape, although at least one end is generally straight. The table top has a generally planar top surface 18.

Figure 7:
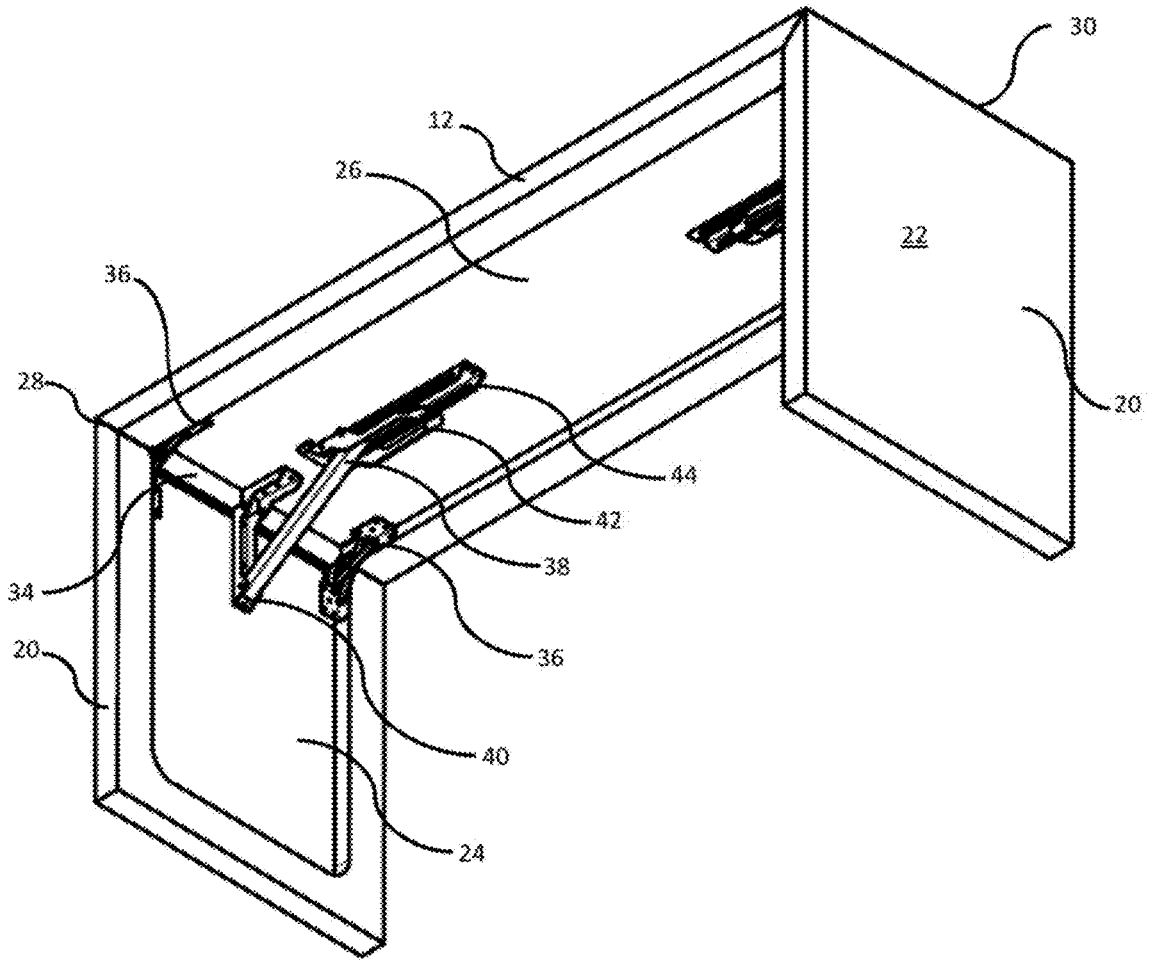
FIG. 7 is a bottom perspective view of the table in the unfolded position.

At each end 14 of the table top 12 there is a downwardly depending leg 20. In the embodiment shown the legs 20 are rectangular panels having the same width between sides as the depth of the table top. The outer surfaces 22 of the legs 20 are generally planar. The thickness of the leg panels are also the same as the table top 12, such that a uniform, somewhat seamless appearance is provided by the table. Such a presentation means that table clothes are not required to cover the tables, as the tables are aesthetically pleasing. There is a recessed portion 24 on the inside of the legs 20 in order to reduce the weight of the legs and the overall assembly. Similarly, the underside of the table top has a recessed portion 26 to reduce weight (as shown in FIG. 7).

It can be seen from FIG. 1 that the only visible seams or mechanisms are the corner joints 28 at the junction between the table top ends 14 and the upper ends 30 of the legs 20.

Figure 2:
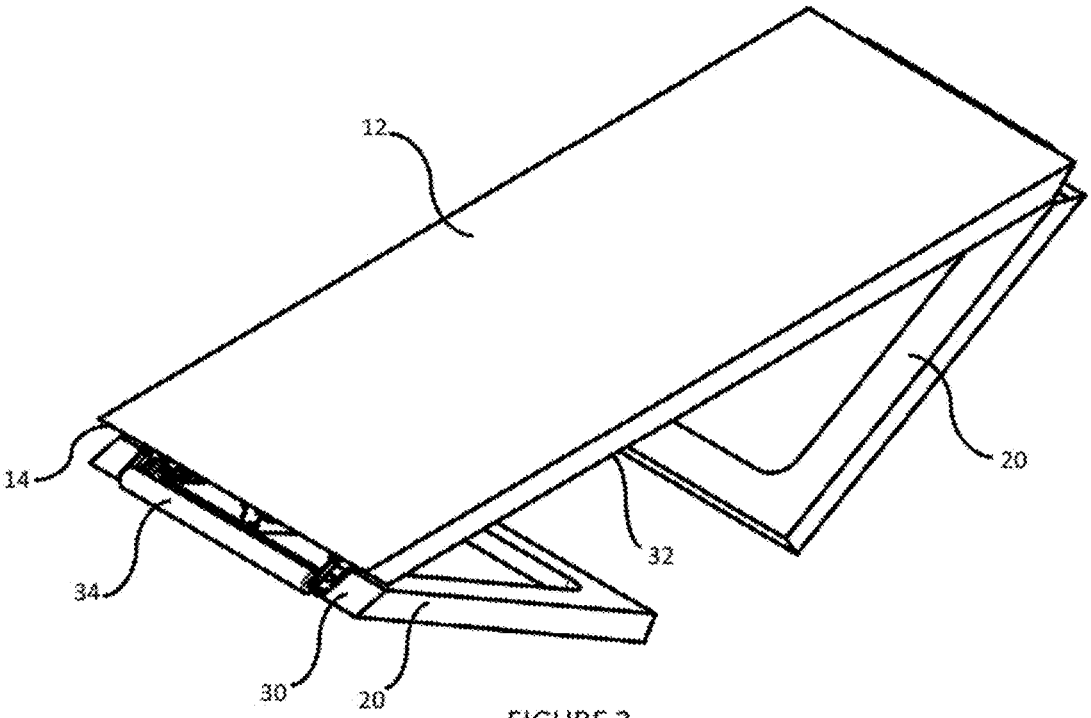
FIG. 2 is a perspective view of the foldable table as the legs are being folded.
Figure 3:
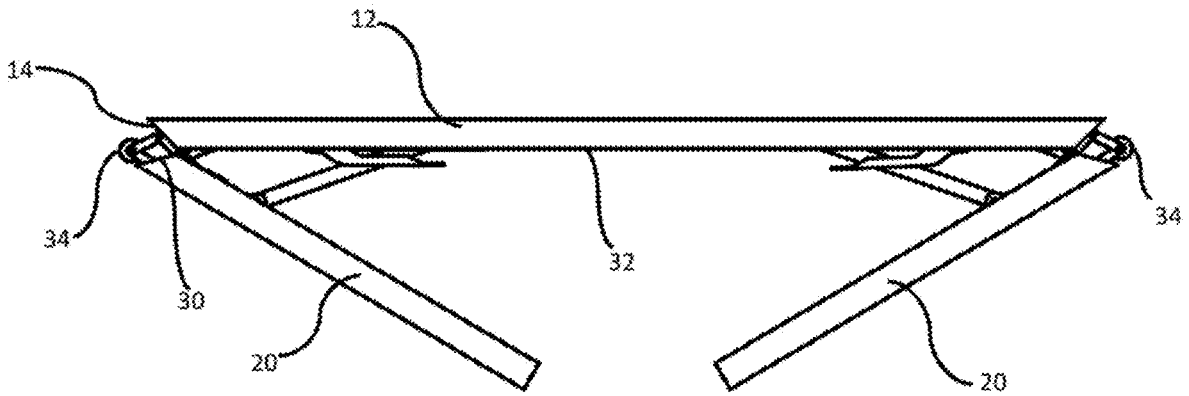
FIG. 3 is a side view of the table as shown in FIG. 2.

FIGS. 2 and 3 show how the table 10 is folded for transport and storage. Both of the legs 20 are folded inwardly toward the underside 32 of the table top 12. It can be seen from these drawings that the corner joints 28 are mitre joints, whereby the end 14 of the table and the upper end 30 of the legs are cut at 45°, such that when the legs are folded, the corners open up, as shown in FIG. 3.

Figure 4:
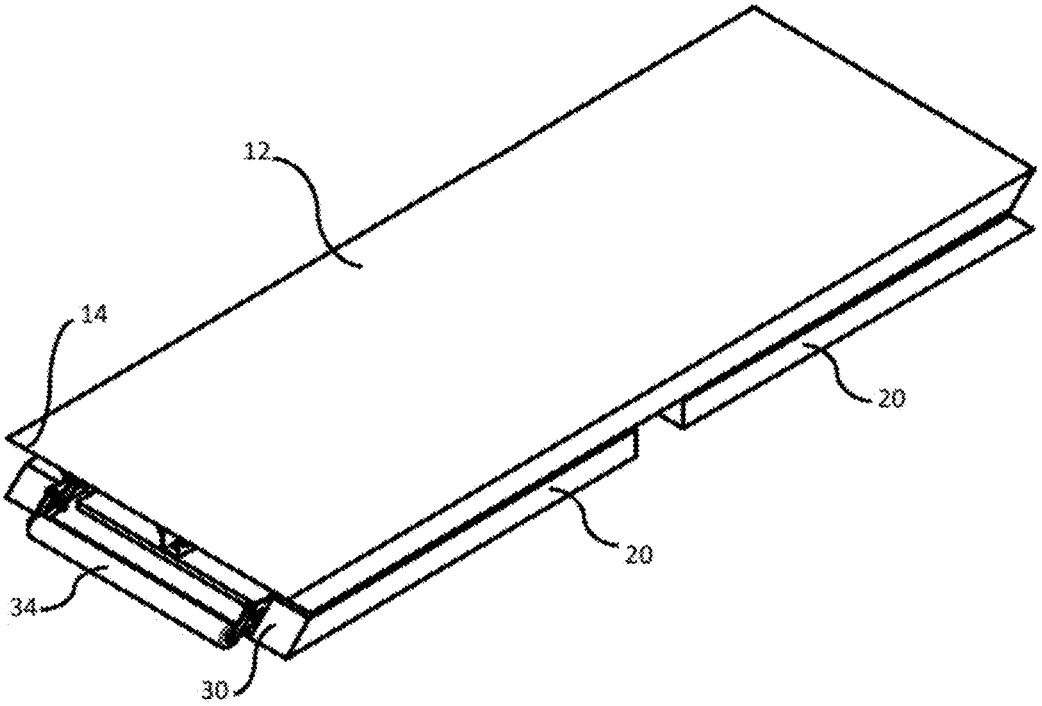
FIG. 4 is a top perspective view of the foldable table in the folded position.
Figure 5:
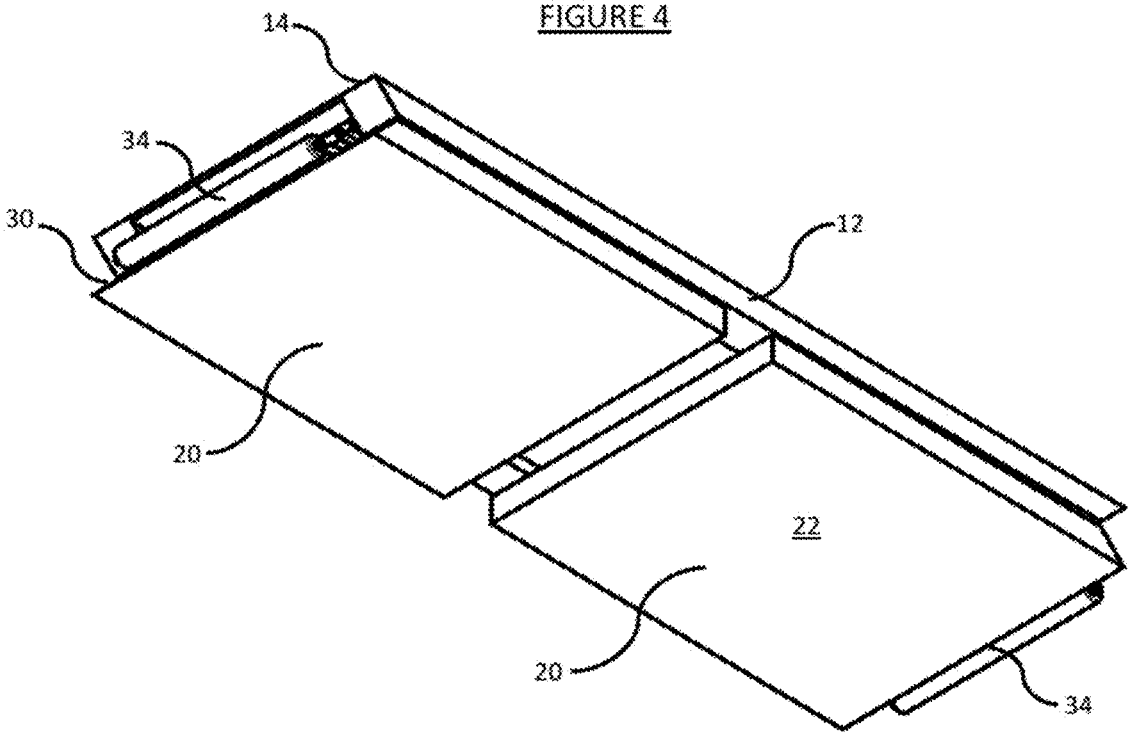
FIG. 5 is a bottom perspective view of the table as shown in FIG. 4.
Figure 6:
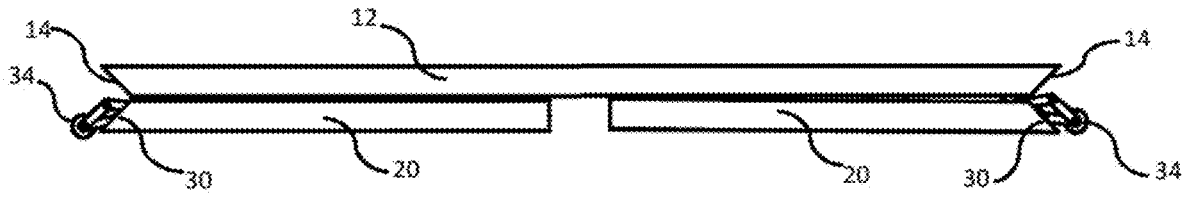
FIG. 6 is a side view of the table as shown in FIG. 4.

FIGS. 4 and 5 show the table 12 in the folded position, with the legs 20 lying underneath and generally parallel to the table top. This provides a flat upper and lower surface when folded allowing for easy and efficient stacking.

As can be seen best in FIG. 4, when the table 10 is in the folded position, a roller device 34 protrudes from the end. It will be appreciate that the drawings show a single roller device at each end, although one may be provided at only one end. The roller device allows the table to be tilted upwards enabling the folded table to be wheeled along the floor surface to rearrange or move to storage. The benefit of having tables with rollers means that handling can be achieved by a single person. The roller at the end that is lifted can be used as a handle by the operator to manoeuvre the table while rolling.

A single roller 34 is shown at each end of the table top, however it will be appreciated that more than one spaced apart roller may be used, although it is desirable that they share a common axle.

The legs 20 are connected to the table top 12 using standard mitre joint corner hinges 36. Two hinges 36 are provided, one towards each side 16 of the table top 12. A stabilising strut 38 is used in the centre at each end, with a first end 40 being pivotally connected to the leg 20 and a second end 42 being slidable connected to a rail 44 on the underside of the table top. As the leg 20 is folded, the second end 42 slides along the rail 44 towards the centre of the table top, as can be seen in FIG. 7. This is a standard stabilising system for folding tables.

Figure 8:
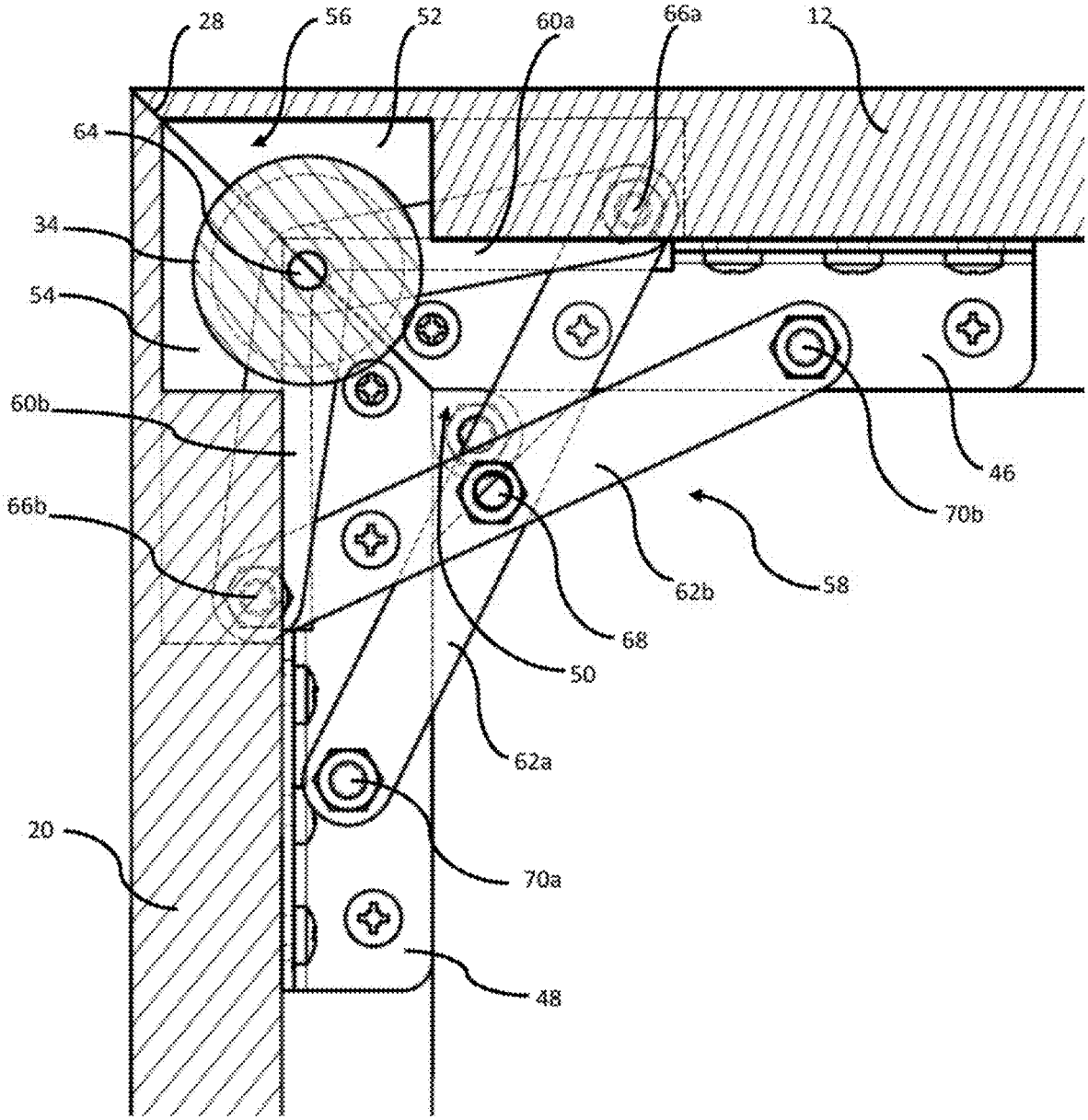
FIG. 8 is a side cross-sectional view of the corner of an unfolded table.
Figure 9:
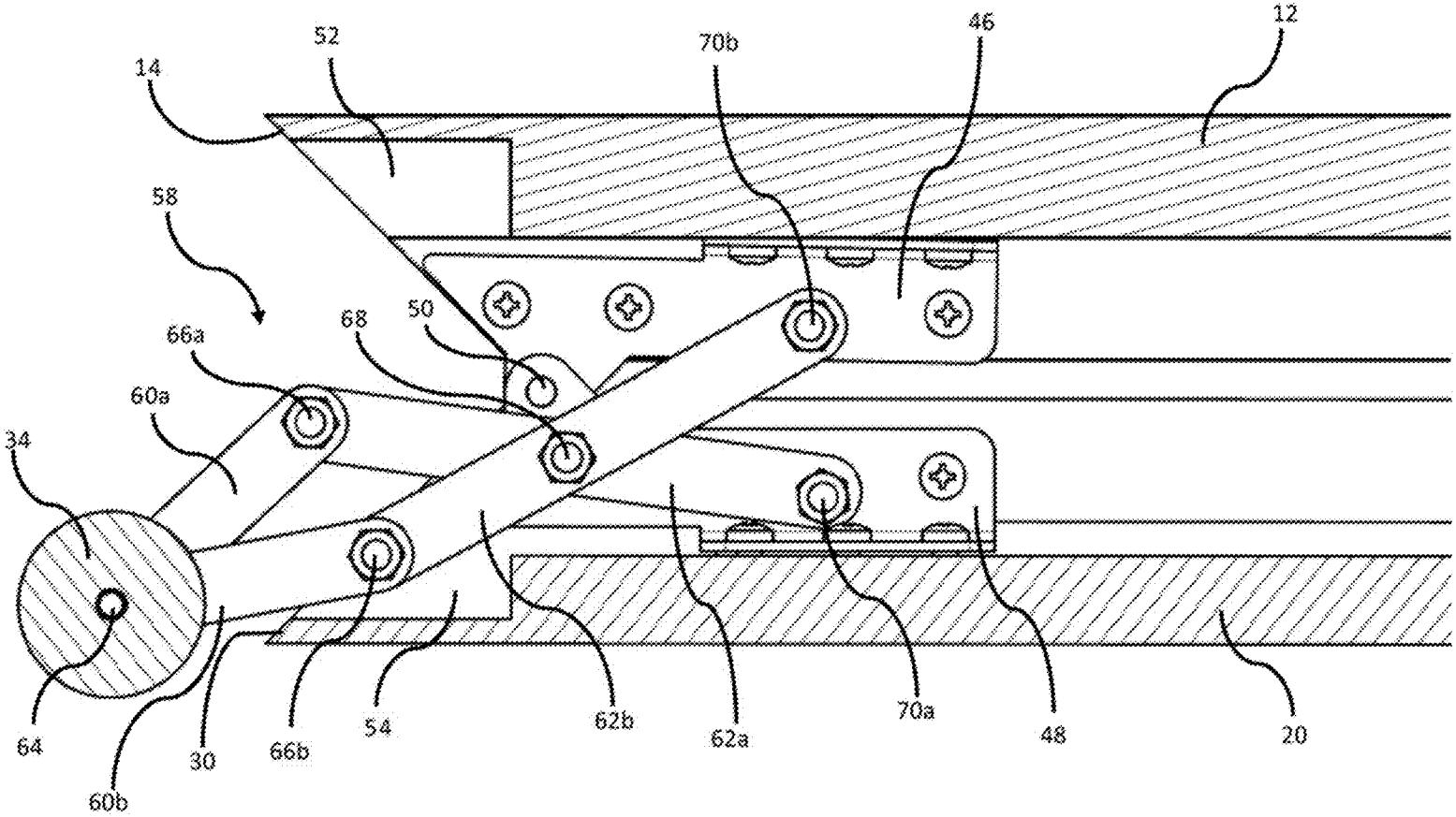
FIG. 9 is a side cross-sectional view of the corner of a folded table.

Referring to FIGS. 8 and 9, the standard mitre joint corner hinge 36 includes a first bracket 46 connected to the underside of the table top. A second bracket 48 is connected to the leg 20 and the two brackets 46, 48 are joined together by central pivot 50.

Adjacent the ends of the hinge 36, at the end 14 of the table top and the upper end 30 of the leg, there are cut out portions 52, 54. The cut out portions 52, 54 together form a pocket 56 into which the roller 34 is partially or fully received when the leg is unfolded, as shown in FIG. 8. The pocket does not extend the full depth of the table. As shown in FIG. 7, the pocket and roller 34 only extend the width of the recessed portions 24, 26, so that the roller and brackets are concealed within the unfolded table.

The roller 34 is connected at each end to a scissor link hinge 58. The scissor link hinge 58 is constructed from four arms, two shorter arms 60*a*, 60*b* and two longer arms 62*a*, 62*b*. The outer ends of the shorter arms 60, 60*b* pivotally join at roller axle 64. The shorter arms connect to the longer arms at pivot points 66*a*, 66*b*. The longer arms 62*a*, 62*b* cross over each other and are connected together at pivot point 68. The ends of the longer arms are then respectively joined to the first and second hinge brackets 46, 48 via pivot points 70*a*, 70*b*. These connections are such that, as the leg 20 is folded and the second bracket 48 is moved towards the first bracket 46, the end pivots 70*a*, 70*b* of the long arms 62*a*, 62*b* are moved together. This forces pivots 66*a*, 66*b* towards each other, lengthening the arms outwardly and extending the roller 34 outward from the pocket 56 between the end 14 of the table top and the end 30 of the leg, as shown in FIG. 9.

The long arms 62*a*, 62*b* are of different lengths, with arm 62*a* being longer than arm 62*b*. The connecting pivot 68 is located half way along the length of the longer arm 62*a*. The pivot 68 placement on the shorter arm 62*b* is further towards the shorter arms. The result of this non symmetry is that as the scissor link hinge 58 extends outwardly from the pocket 56, the roller follows an arc and moved down so that it is closer to the edge 30 of the leg. When the folded table is tilted and rolled, because the roller is closer to the floor surface, the edges 14 and 30 are protected from damage and the table is not required to be lifted as high as if it extended evenly.

As the table is unfolded, the scissor link hinge 58 works in the reverse, with the first and second hinge brackets 46, 48 drawing apart. This moves the ends of the long arms 62*a*, 62*b* apart, which draws the roller inwards to sit within the pocket 56 as the corner closes.

Figure 10:
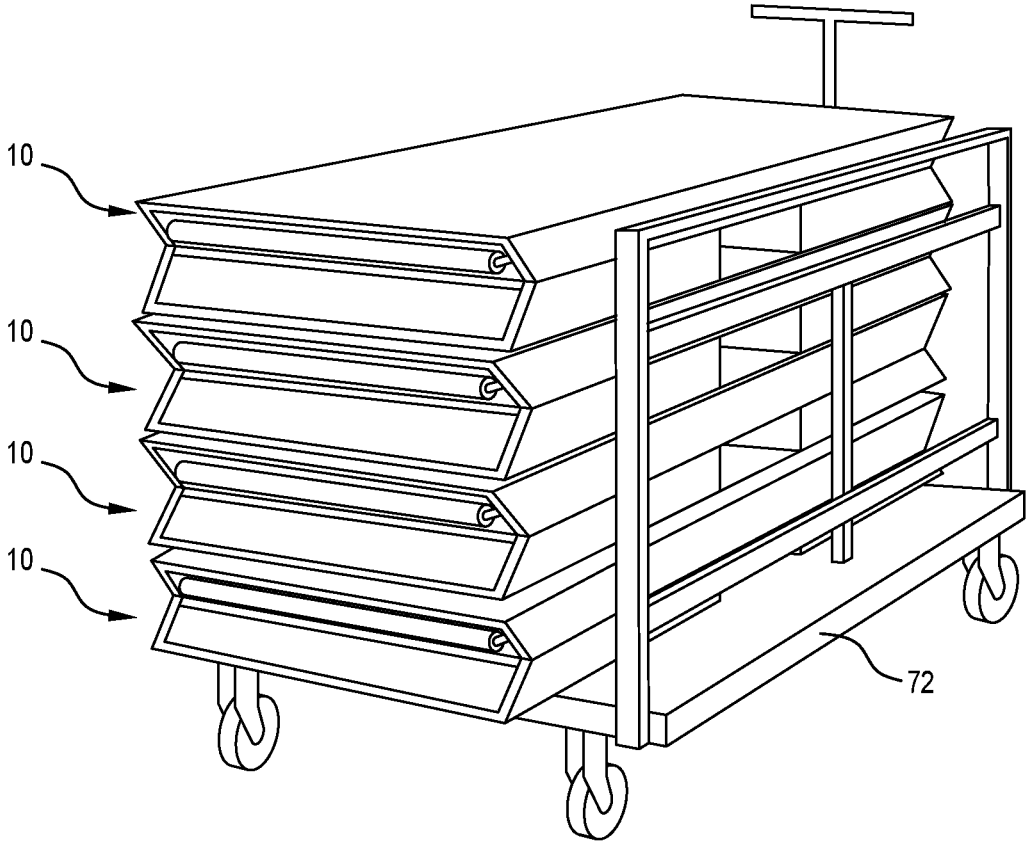
FIG. 10 is a perspective view of a stack of folded tables on a storage trolley.

As shown in FIG. 10, when the tables are in the folded position, the legs lie parallel to the table top, such that a planar upper and lower surface is presented. This makes stacking of multiple tables much easier than existing systems. Multiple tables can be stacked in a horizontal orientation on a trolley 72 and wheeled into storage.

Figure 11:
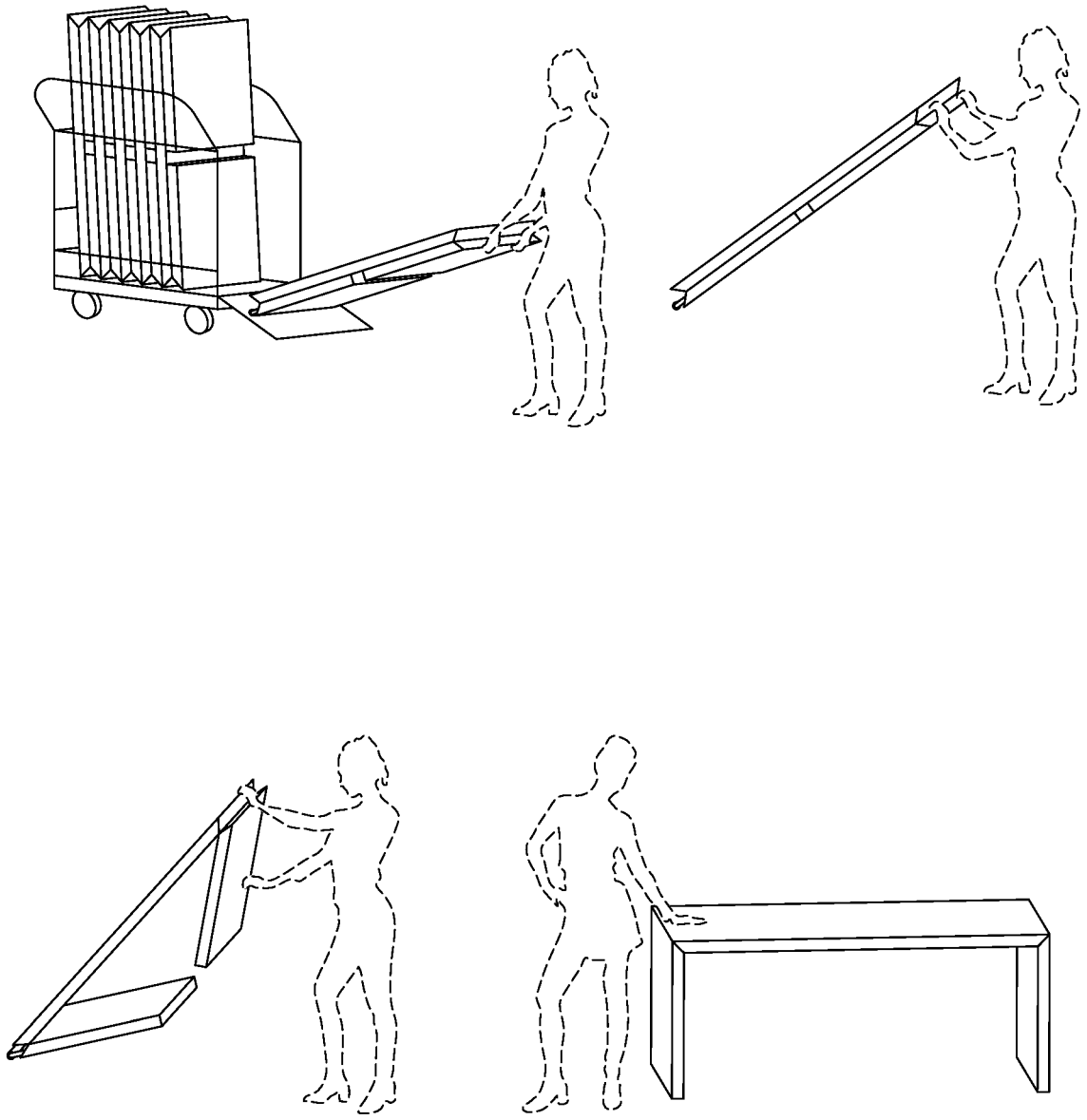
FIG. 11 is a pictorial representation of a person setting up a table according to the invention.

Alternatively, as shown in FIG. 11, the tables 10 can be stacked generally vertically using an upright trolley 74. A single user can roll a table 10 off of the trolley without assistance, unfold the legs and stand the table up. The present invention provides an aesthetically pleasing rollable foldable table that conceals the rolling device when unfolded and exposes it for ease of use when folded.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A folding table, including:

a table top having a top surface and a bottom surface;

two opposing legs at or adjacent respective opposing ends of the table top; the legs being movable between an unfolded position for supporting the table top above a floor surface, and a folded position whereby the legs lie underneath the bottom surface;

at least one roller device located towards at least one of the opposed ends of the table top;

wherein an underside of the table top, at the at least one of the opposing ends, and an upper end of the respective leg, at the at least one of the opposing ends, each has a cut out portion that does not extend the full depth of the table top such that the cut out portion is not visible from that side of the table top, wherein the cut out portion at the underside of the table top and the cut out portion at the respective leg correspond to form a pocket on the inside of a corner when in the unfolded position;

whereby in the unfolded position the roller device is partially or fully received within the pocket, and in the folded position the roller device is exposed to the end of the table top to allow rolling of the table in a tilted orientation along a floor surface.

2. A folding table according to claim 1, wherein the top surface of the table top is planar.

3. A folding table according to claim 1, wherein the legs are panels extending in width the same as the depth of the table top.

4. A folding table according to claim 1, wherein the legs have an exterior that is planar.

5. A folding table according to claim 4, wherein the table top and each respective leg of the two opposing legs meet at a mitre joint.

6. A folding table according to claim 1, wherein the at least one roller device comprises a single roller device at each of the opposing ends of the table top, wherein the underside of the table top at each of the opposing ends and the respective legs at each of the opposing ends each have the cut out portion that does not extend the full depth of the table top such that the cut out portions are not visible from the sides of the table top, wherein the cut out portions at the underside of the table and the cut out portions at the respective legs correspond to form the pocket on the inside of each corner when in the unfolded position, whereby in the unfolded position the roller device at each end is partially or fully received within its respective pocket, and in the folded position the roller devices are exposed to respective ends of the table top to allow rolling of the table in a tilted orientation along a floor surface.

7. A folding table according to claim 1, wherein the legs and table top are connected by a corner hinge connection, having a first bracket on the table top and a second bracket on the leg, with a central pivot.

8. A folding table according to claim 7, wherein the roller device is connected to a scissor link hinge.

9. A folding table according to claim 8, wherein the scissor link hinge includes at least four hinged arms, the hinged arms at one end of the scissor link hinge being commonly connected to the roller device, and the hinged arms at the other end of the scissor link hinge being split so that at least one of the hinged arms is attached to the corner hinge first bracket and at least one other hinged arm is attached to the corner hinge second bracket, whereby, as the leg is folded, the scissor link hinge extends the roller device outwardly from and between the table top end and the upper end of the leg, and, as the leg is unfolded, the brackets move apart, drawing the ends of the scissor arms outwards and drawing the roller device inwards to sit within the pocket.

10. A folding table according to claim 9, wherein the scissor arms have different lengths such that they position the roller device downwards away from the table top.

11. A folding table, including:

a table top having a top surface and a bottom surface;

two opposing legs at or adjacent respective opposing ends of the table top; the legs being movable between an unfolded position for supporting the table top above a floor surface, and a folded position whereby the legs lie underneath the bottom surface;

at least one roller device located towards at least one of the opposed ends of the table top, wherein the roller device is connected to a scissor link hinge;

whereby in the unfolded position the scissor link hinge draws the roller device inwards so that it is not exposed to the end of the table top, and in the folded position the scissor link hinge extends the roller device outwards so that it is exposed to the end of the table top to allow rolling of the table in a tilted orientation along a floor surface.

12. A folding table according to claim 11, wherein the top surface of the table top is planar.

13. A folding table according to claim 11, wherein the legs are panels extending in width the same as the depth of the table top.

14. A folding table according to claim 11, wherein the legs have an exterior that is planar.

15. A folding table according to claim 14, wherein the table top and each respective leg of the two opposing legs meet at a mitre joint.

16. A folding table according to claim 11, wherein the legs and table top are connected by a corner hinge connection, having a first bracket on the table top and a second bracket on the leg, with a central pivot.

17. A folding table according to claim 16, wherein the scissor link hinge includes at least four hinged arms, the hinged arms at one end of the scissor link hinge being commonly connected to the roller device, and the hinged arms at the other end of the scissor link hinge being split so that at least one of the hinged arms is attached to the corner hinge first bracket and at least one other hinged arm is attached to the corner hinge second bracket, whereby, as the leg is folded, the scissor link hinge extends the roller device outwardly from and between the table top end and the upper end of the leg, and, as the leg is unfolded, the brackets move apart, drawing the ends of the scissor arms outwards and drawing the roller device inwards to sit within the pocket.

18. A folding table according to claim 17, wherein the scissor arms have different lengths such that they position the roller device downwards away from the table top.

* * * * *